United States Patent [19]

Greenway

[11] Patent Number: 4,753,839

[45] Date of Patent: Jun. 28, 1988

[54] STRETCHABLE FABRIC

[75] Inventor: John M. Greenway, Westwood, Mass.

[73] Assignee: Fiber Technology Corporation, Walpole, Mass.

[21] Appl. No.: 921,651

[22] Filed: Oct. 20, 1986

[51] Int. Cl.[4] ..... D06N 7/04

[52] U.S. Cl. ..... 428/152; 428/221; 428/222; 428/224; 428/280; 428/913

[58] Field of Search ..... 428/152, 221, 222, 224, 428/280, 913; 28/104

[56] References Cited

U.S. PATENT DOCUMENTS

| | | | |
|---|---|---|---|
| 3,485,706 | 12/1969 | Evans | 28/109 |
| 3,485,709 | 12/1969 | Evans et al. | 428/224 |
| 3,620,903 | 11/1971 | Bunting et al. | 428/224 |
| 3,906,130 | 9/1975 | Tsurume et al. | 28/104 |
| 4,548,628 | 10/1985 | Miyake et al. | 28/104 |
| 4,612,226 | 9/1986 | Hennette et al. | 428/222 |

*Primary Examiner*—James J. Bell

*Attorney, Agent, or Firm*—Francis J. Clark

[57] ABSTRACT

A stretchable textile-like fabric comprising at least one layer of nonwoven fibers hydroentangled into a diamond shaped structure so that a substantial number of fibers are oriented equally on all sides of the diamond. This fiber orientation results in a balanced fabric structure. Subsequent to entangling the fibers, they are compacted so as to arrange the fibers into a series of wave-like configurations. The combination of the diamond shape fabric structure and the wave-like configurations of the fibers permits multi-directional stretch in the fabric when tension is applied. Additionally, when the tension in the fabric is released, the inherent memory of the fibers causes the fabric to return to its original form without substantial permanent deformation.

4 Claims, No Drawings

STRETCHABLE FABRIC

BACKGROUND OF THE INVENTION

1. Field of Invention

This invention relates to textile-like patterned nonwoven fabrics entangled by liquid streams. More particularly it relates to a textile-like nonwoven fabric that has multi-directional stretch characteristics when tension is applied to it and then will recover to its original form when the tension is released.

2. Prior Art

Although prior art has been able to produce textile-like patterned nonwoven fabrics, entangled by liquid streams, they have not been able to produce a nonwoven fabric with multi-directional stretch and recovery. The present invention has accomplished this. This particular textile-like fabric has many applications such as wiping cloths, apparel and other related items that require stretch and recovery in a fabric.

In U.S. Pat. No. 3,485,706 there are described textile-like nonwoven fabrics made from fibers that were randomly entangled. One such fabric is referred to as Example 47, product (E). This fabric has fibers randomly deposited in a web by an air-laying technique. The web is then deposited onto an oblong, 30×8 mesh screen, and subjected to high-energy water streams. This results in an entangled fabric that has a zig-zag pattern of ridges on the faces of the fabric. The zig-zag pattern has dark entangled regions along fiber bands which are formed between the widely spaced screen wires. The zig-zag entangled regions lock the fibers in place in the fabric.

This fabric, being entangled on an oblong screen has the capability to stretch in two directions. The resulting fabric may stretch 32% in the machine direction and 32% in the cross direction of the fabric.

A disadvantage with this fabric is that when it is subjected to tension and the tension is released the fabric will not recover to its original form. This is caused by the orientation of the fibers in the fabric. The fibers in the fabric are substantially machine direction oriented. Thus when tension is applied in that direction and the fabric is stretched, the fibers slide over one another. Because of this permanent deformation in the prior art fabric, it will not recover its original form. Additionally, when tension is applied in a cross direction, to a fabric which has fibers oriented in a machine direction, the fibers tend to slide past one another. Thus the fabric is not able to recover its original shape. Another disadvantage is that this prior art cannot be substantially stretched in a bias direction, because the fibers are oriented in the machine direction they will not move in that direction, but will move apart from each other.

The present invention has overcome the above-mentioned disadvantages, which will be evident in the remaining Specification.

An object of the present invention is to provide a textile-like non-woven fabric having multi-directional stretching capabilities.

Another object of the present invention is to provide a fabric that will, after being stretched, recover without substantial deformation to its original form when the tension is released.

Still another object of the present invention is to provide a fabric having the feel, drape, conformability and stretch characteristics of a woven fabric or knit fabric.

Another object of the present invention is to provide a comfortable fabric.

A further object of the present invention is to provide a fabric that has a balanced structure.

Another object of the present invention is to provide a durable fabric.

SUMMARY OF THE INVENTION

A stretchable fabric comprised of at least one layer of a blend of cellulosic and thermoplastic fibers hydroentangled into a diamond shaped structure, whereby a substantial number of fibers are arranged equally on all sides of the diamond. This fiber arrangement results in a substantially balanced structure. In the hydroentangled form, subsequent to entangling the fibers, the fibers are compacted. Compacting arranges the fibers into a series of wave-like configurations. The diamond shaped structure and the wave-like configurations of the fibers permit the present invention fabric to have multi-directional stretch when tension is applied. The fabric also has substantial recovery to its original form when the tension is released, without substantial deformation of the fabric. In addition, the compacting of the fibers locks them together which improves the durability of the fabric.

DESCRIPTION OF PREFERRED EMBODIMENT

The basic fabric of the present invention, is at least one layer of a nonwoven web of loose fibers, formed by conventional means such as carding or air laying of fibers. The basic fabric of the present invention is subjected to streams of liquid to entangle the fibers. The basic fabric is hereinafter referred to as "hydroentangled fabric". The present invention fabric comprises fibers mechanically locked into place by fiber interaction to provide a strong, uniform, cohesive structure with dense entangled regions of fibers, which maintains a structural integrity without the need for binders. Within this fabric there are interconnecting fibers which extend between the dense entangled regions and are randomly entangled with each other in the dense entangled regions. The entanglement of the present invention is accomplished by first preparing a fibrous web consisting of a loose layer or layers of fibers and then passing the web of loose layered fibers onto a specially constructed 45° angled screen where it is treated with liquid jetted at high pressures from one or more rows of smaller orifices to convert the web into a diamond shaped entangled nonwoven fabric. As the web is formed into a diamond shaped structure the fibers are substantially distributed equally on all sides of the diamond, resulting in a balanced fabric structures. For the purpose of this application a balanced fabric structure may be defined as a fabric whose fibers, when entangled, are positioned equally on all sides of a diamond formed by 45° angles.

A 45 ° screen is made by cutting a 90° screen, in 12 inch wide strips on a bias of 45°. The screen may be any width. The cut screen is then wound circumferentially around a drum aligning the wires of the screen in a 45° angle. As the screen is being wound on the drum the parallel mating or adjacent edges of the screen are joined together to form a finished screen. Other methods of creating 45° screens may also be used, such as that illustrated in FIG. 7. The screen is a 90° screen approximately 12 inches wide. The width of the screen would depend on the diameter of the drum it would be wound onto. The 90° screen is then wound in a helical spiral around a drum. The adjacent seams of the screen are then joined together to form a continuous screen.

The 90° screen is wound onto a drum at a 45° angle so as each section of the screen is seamed together the wires within the screen will be at a 45° angle. The 45° angle of the screen is necessary, because it orientates the fibers within the basic fabric to follow the angle of the wires in the screen. This results in a fabric having equal bundles of fibers running substantially in left and right bias directions across the fabric, forming a diamond shaped fabric. The importance of this fiber orientation will be discussed in subsequent paragraphs. Although a 45° screen is preferred, other angled screens such as 30°, 60° screens but not limited to, may be used, with a slightly different result.

Prior art fabrics are made with a standard 90° screen, thus a web formed on such a screen will have its fiber bundles substantially orientated in the machine direction and cross direction or perpendicular to each other. This results in the bundles of fibers in the machine direction being substantially heavier than the bundles of fibers in the cross direction. This orientation of fibers gives maximum strength in the machine direction and minimum strength in the cross direction. The present invention because of its balanced fiber structure gives substantially equal strength in both directions.

In accordance with the present invention, at least one layer of a blend of cellulosic fibers, preferably rayon, and at least 15 percent of thermoplastic fibers, preferably polyester, is formed into a hydroentangled diamond shaped fabric structure. Although the preferred blend is 50% rayon and 50% polyester, other fibers such as polypropylene, acrylic, polyethylene and cotton may be used with similar results. The fibrous layer may be 100% cellulosic or 100% thermoplastic. This diamond shaped structure is formed by passing at least one layer of loose fibers through an entangler, as described above, having rows of high pressure water jets. The diamond structure has diamond shaped voids which are the result of the fabric being formed on a 45° wire screen. The voids form wherever a crossover point in the screen occurs, because the fibers are washed from the raised crossover points. A crossover point is defined as the point where the wires of the screen crossover each other in forming the screen. It should also be noted that the entangled fibers in the fabric substantially follow the 45° structure of the screen, thus are at the same angle to each other. Although one layer of blended fibers is preferred, multiple layers of various combinations of blends of fibers may be used to give variations of the fabric. In addition, the layer or layers of fabric may be 100 percent thermoplastic depending on the requirements of the fabric.

The hydroentangled nonwoven fabric so made is then passed into a compactor. The fabric is passed into a compactor to form the fibers into wave-like configurations. Hydroentangled fibers are driven forward by a heated rotary main roll into the nip between the main roll and a pressure assembly. The heated main roll may have a grooved surface or, as preferred a smooth, cylindrical surface. The temperature to which the main roll is heated depends on the particular fabric being compacted. It is typically heated to preferably about 270° F. or less depending on the process speed and cavity temperature in the compactor. As the fibers of the fabric move into the nip, the pressure assembly forces the fibers toward the surface of the main roll keeping them in contact with the main roll. A retarder element or high friction surface is used to retard the fibers as they pass from the pressure assembly, into the cavity area. The retarder element retards the fiber and causes them to form into wave-like configurations.

The combined action of the main roll, the pressure assembly and the retarder element imparts pleats, having crests and valleys, to the fibers. The fibers are squeezed or compacted in such a way as to cause the fibers to be rearranged into a repeating series of wave-like configurations extending substantially along their length at 45° angles while in the diamond shaped structure. The pleating of the fibers takes place due to the heat from the main roll, which softens them so when they contact the retarder element, they are formed into a pleated or wave-like form. This pleating of the fibers assists in locking the fibers together to enhance the stretch and recovery properties of the fabric. As the fabric, with its fibers in their new rearranged wave-like forms, leave the area of the heated main roll it cools, with the fibers maintaining their pleated form.

Compacting of thermoplastic fibers such as those used in the present invention have their physical properties controlled via the temperature in the cavity of the compactor. Prior art methods use the temperature of the heated roll to try to control the fiber properties, but were not successful in doing so.

Compacting trials, using conventional compacting methods, were conducted where thermoplastic fibers formed part of the web. It was found that excessive and unpredictable shrinkage of the fibers occurred when the web was compacted at process speeds exceeding 50 ft/min. This limited the process speed to 50 ft/min in order to achieve reproducible results.

Compacting temperatures in conventional compactors are usually controlled via the heated roll temperature. It has been established, in the method used to produce the present invention, that by using a thermocouple, approximately $\frac{5}{8}$ths of an inch from the cavity, that the cavity temperature in the compactor increased with process speed. The present method of compacting as described herein has established that the cavity temperature and not the heated roll temperature determines the stretch and recovery properties of fibers that comprise a compacted web. Controlling the cavity temperature permits control of the compaction process so as to achieve reproducible fiber compaction results.

Cellulose or non-thermoplastic fibers similar to those used for paper products are relatively unaffected by cavity temperature and hence speed related problems are not encountered when compacting these types of products. On the other hand, thermoplastic fibers such as those used in the present invention shrink when exposed to high temperatures, hence, when compacting textile-like products, such as the present invention, product properties become unpredictable at higher process speeds.

The present method of compacting as described herein, has established that cavity temperature depends on a number of factors. These factors include the frictional characteristics of the fabric, the weight and structure of the fabric and also the cavity conditions such as head pressure and the frictional and heat transfer characteristics that exist just prior to the cavity and in the cavity itself.

The only practical way of determining cavity temperature is by introducing a thermocouple either directly above or in the area of the cavity. It can be seen that the maximum temperature sensed by the thermocouple was just before the cavity. The term "cavity temperature" relates to the temperatures in the area of the cavity.

It was established experimentally that to achieve optimum multi-directional stretch and recovery properties in the present invention of compacted fibers it was necessary to maintain a cavity temperature in the of range 250° to 270° F. The thermocouple placed above the cavity and in contact with the retarder measures the temperature. The preferred temperature being 270° F. with the thermocouple placed approximately ⅝ of an inch forward of the cavity step. The only practical way of controlling cavity temperature is via heated roll temperaure and process speed. Using a thermocouple to measure cavity temperature established that in order to achieve the required fabric properties of stretch and recovery and to prevent excessive shrinkage, it was necessary to reduce the heated roll temperature with increased process speed. The heated roll temperature was reduced by approximately 60° F. so that at process speeds of over 100 ft/min the cavity temperature fell into the required range. While the temperature of the roll was reduced by 60° F., the temperature of the fibers at the cavity step increased to 270° F. This was due to the frictional action on the fibers by the retarder and primary blade rubbing against the fibers. The cavity temperature was maintained in this range by varying the process speed. As the cavity temperature fell the process speed was increased and when the cavity temperature became too high the process speed was reduced.

It may be possible to use a simple control circuit so as to automatically vary process speed in order to maintain a constant predetermined cavity temperature.

The present invention fabric, having a diamond shaped structure and fibers that are accordian pleated, has the ability not only to stretch in multi-directions, but to substantially recover or return to its original form once the tension is released. The diamond structure of the fabric permits the fabric to have a scissors-like action when a force is applied or removed without substantial distortion resulting to the fabric of the present invention. The stretch and recovery of the present invention fabric is due to the scissors-like action of the balanced diamond structure, the built-in memory of the compacted fibers, and the fact that the compacted fibers lock themselves together forming a united structure.

In the present invention the fibers are compressed and arranged in wave-like configurations by the compacting process. Normally compacting is used to increase the bulk or loft or a fabric and not to decrease these characteristics. The present invention unexpectedly achieved a decrease in its bulk/thickness whereas prior art increased in bulk. After compacting the present invention fabric was approximately 30% thinner than its original thickness.

The aforementioned fabric properties also enable the novel present invention nonwoven fabric to simulate a conventional knitted fabric in terms of its ability to stretch and recover. The present invention also has characteristics usually associated with those of a woven or knit fabric. These characteristics are drape, feel conformability and comfort. In addition, the aforementioned provides a fabric that has substantially no deformation because it will substantially recover or return to its original form, when tension is released.

Tests were performed on the present invention stretchable fabric and prior art fabric to illustrate the advantage the present invention has over the prior art. This is illustrated in the following test results.

The following are the test results:

| PHYSICAL PROPERTIES | | | | | |
|---|---|---|---|---|---|
| SAMPLE DESCRIPTION | Present Invention | | Prior art | | |
| WIDTH | 2 INCHES | | 2 INCHES | | |
| LENGTH | 7 INCHES | | 7 INCHES | | |
| FORMING SCREEN | 45° | | 90° | | |
| | 14 × 16 | | 14 × 16 | | |
| COMPACTING ROLL | PLAIN ROLL | | COMB ROLL | | |
| COMPACTION % | 30 | | 30 | | |
| FABRIC WT. (gsy) | 68 | | 51 | | |
| AMES THICK. (mils) | 19.3 | | 47.6 | | |
| | MD | CD | MD | CD | |
| TENSILE (lb/in) | 9.15 | 10.25 | 8.9 | | 6.2 |
| ELONGATION (%) | 85 | 102 | 89.6 | | 107 |
| STRETCH % (½ LB/IN LOAD) | 37.5 | 27.2 | 37.5 | | 34 |
| STRETCHED FABRIC LENGTH | 9.5 | APPROX 2" | 9.5 | APPROX 2" | |
| FABRIC LENGTH AFTER RECOVERY | 7.7 | 2" | 8.2 | 2" | |
| PERM DEFORMATION (%) | 7.0 | 7.0 | 18.3 | 17 | |
| STRETCH ENERGY (LB IN/IN$^2$) | .144 | .092 | .048 | | .057 |
| RECOVERY ENERGY (LB IN/IN$^2$) | .065 | .045 | .016 | | .013 |
| RESILIENCE (%) | 45 | 48 | 33 | | 23 |
| % FABRIC RECOVERY | 73 | 74 | 51 | 50 | |

As shown by the tests, the advantage that the present invention has over prior art is its property of elasticity or resilence which results in substantially no deformation of the fabric. This is due to the % fabric recovery of the present invention fabric which as shown in the test results is substantially higher than the prior invention. The geometry of the diamond in the present invention permits the multi-directional stretch. The resilence in the fibers permits the present invention fabric to have a high % fabric recovery which permits it to return to its original form without substantial deformation. For the purpose of this application, deformation of a fabric results when the fabric is stretched beyond its elastic state to a plastic or permanent deformation state from which it cannot recover. Elasticity or resilience for the purposes of this invention is the capability of a material to return to its original form immediately upon withdrawal of a force which causes distortion. As illustrated in the aforementioned test results the present invention fabric has a substantially high percent of resilience in the machine direction (MD) when compared with the prior art, but has an even higher percent resilience in the cross direction (CD) when compared with the prior art. The test results show that the prior art sample is constructed to specifically stretch in the machine direction while the present invention fabric is designed to stretch in both directions equally, thus making it superior to the prior art. With a high percent resilience of the present invention fabric there is substantially no deformation of the fabric. The test results show a high percent of recovery as a result. In addition, even though the present invention fabric has substantially no deformation, as shown in the test results. Absolute recovery of the present invention fabric may be had by applying a slight tension in the cross direction to counteract any resistance of the fabric structure to recovery fully. This applied tension, because of the diamond structure, acts to restore the fabric structure substantially back to its original form. FIG. 10 is a graph illustrating the tensile energy/stretch and recovery energy of the present invention fabric.

Curve A of the graph depicts the stress/strain characteristics of the fabric as it is stretched to maximum load of ½ lb/inch width. The area under the curve is the tensile energy strength required to stretch the fabric.

Curve B of the graph depicts the stress/strain characteristics of the fabric as it is allowed to recover from ½ lb/inch load down to zero loading. The area under the curve is the recovery energy of the fabric.

The areas under the curve are be measured by an integrater which is part of an Instron tester. The Instron tester is made by Instron Co. of Canton, Mass.

The characteristic values of the above are:

WT=TENSILE/STRETCH ENERGY/UNIT AREA (LB IN/IN$^2$)

WT'=RECOVERY ENERGY/UNIT AREA (LB IN/IN$^2$)

RT=RESILIENCE

The characteristics values are defined by:

$$WT=Fd\ (lb\ in/in^2)$$

$$WT=F'\dot{d}\ (lb\ in/in^2)$$

$$RT=(WT'/WT).100$$

Where $F$ = Tensile force/unit width (lb/in)
= Tensile strain
$Fm$ & $m$ = Maximum values of $F$ &
$F'$ = Recovery forces(lb/in)

It should also be noted that it was unexpectedly found that the present invention fabric withstood repeated stretch and recovery cycles and maintained a useful degree pf stretch to a far greater extent than the prior art fabric.

This was illustrated by subjecting the present invention fabric and a prior art fabric to 20 cycles of stretch and recovery, at ½ lb/in load on an Instron tensile tester. The results were as follows:

| | Present Invention | | Prior Art | |
|---|---|---|---|---|
| | MD | CD | MD | CD |
| Stretch and Recovery after 20 cycles (½ lb/per in) | 19% | 17% | 10% | 10% |

The ability of the invention fabric to withstand continuous stretching is important because the fabric will be used for a garment and will be worn and removed many times. The garment/fabric will also be washed or cleaned many times which will subject it to a variety of forces which tend to untangle the fibers. Because the invention fabric has almost twice the stretch and recovery of the prior art fabric, demonstrated during a 20 cycle test, the present invention is well suited to withstand every day use, washing and cleaning. On the other hand the stretch and recovery characteristics of the prior art fabric when used under similar circumstances will be reduced to a point where they would be no longer significant.

To further illustrate the present invention an example is given. This example is not intended to limit the present invention to other than the following claims.

EXAMPLE 1

A 49 gram per square yard web of predominantly machine direction fibers was prepared by using a conventional carding system and an airlay system. The web consists of a blend of 50% 1.5 denier rayon fiber and 50% 1.5 denier polyester fibers. The web was deposited on a 40° 13×13 mesh screen and was entangled on one side, as described herein, using jets of water coming from orifices in line, in two manifolds. The jets being ½ inch above the screen. The pressure of the jets of water was 400 to 800 psi respectively. The partially entangeled web was then transferred onto a special 45° 13×13 mesh drum screen and passed under four additional manifolds having jets of water, with pressures of 1400, 1400, 1600, and 1600 psi, respectively. The entangled web was then taken from the drum screen and passed through the nip of a pair of rolls to extract excess water from it. The fibrous web was then dried conventionally and wound onto a roll.

The fibrous web was then deposited onto a conveyor for delivery into a compactor. Heat was supplied to the compactor by heating a carrying roll, within the compactor. The temperature in the cavity area was controlled by a thermocouple to be 270° F. so as to soften the fibers. As the fibers softened they were moved along to come into contact with a retarder, which arranged the fibers into wave-like configurations. The fibers were then cooled, thus setting them into wave-like configurations.

What is claimed is:

1. A stretchable nonwoven fabric comprising at least one layer of fibers hydroentangled to form a diamond shaped structure, said diamond structure having a substantial number of fibers on all sides of the diamond to form a balanced structure, said fibers being subsequently compacted so as to have a series of wave-like configurations.

2. The fabric of claim 1 wherein the fibers may be non-thermoplastic or thermoplastic or blends thereof such as those selected from the group consisting of polyester, nylon, polypropylene, acrylic, rayon and cotton.

3. The fabric of claim 1 wherein the diamond shaped structure is formed on a 45° angle screen wound circumferentially on a drum to form 45° angles.

4. The fabric of claim 1 wherein the diamond shape structure is formed on a 90° angle screen wound helically on a drum to form 45° angles.

* * * * *